US011572244B2

(12) United States Patent
Taoka et al.

(10) Patent No.: US 11,572,244 B2
(45) Date of Patent: Feb. 7, 2023

(54) IMAGE FORMING APPARATUS

(71) Applicant: CANON KABUSHIKI KAISHA, Tokyo (JP)

(72) Inventors: Keitaro Taoka, Chiba (JP); Hiroyuki Nakagawa, Chiba (JP); Isao Kannari, Saitama (JP); Hiroshi Saito, Ibaraki (JP); Hajime Sekiguchi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 17/203,942

(22) Filed: Mar. 17, 2021

(65) Prior Publication Data

US 2021/0300704 A1 Sep. 30, 2021

(30) Foreign Application Priority Data

Mar. 25, 2020 (JP) ..... JP2020-054354

(51) Int. Cl.

| | |
|---|---|
| ***B65H 1/04*** | (2006.01) |
| ***B65H 11/00*** | (2006.01) |
| ***B65H 15/00*** | (2006.01) |
| *G03G 15/00* | (2006.01) |

(52) U.S. Cl.

CPC ..... *B65H 11/00* (2013.01); *B65H 15/00* (2013.01); *B65H 2511/11* (2013.01); *G03G 15/6511* (2013.01); *G03G 2215/00468* (2013.01)

(58) Field of Classification Search

CPC ..... B65H 11/00; B65H 2511/11; B65H 1/04; B65H 2407/21; B65H 2405/324; G03G 15/6514; G03G 15/6511

See application file for complete search history.

(56) References Cited

U.S. PATENT DOCUMENTS

| | | | |
|---|---|---|---|
| 5,046,947 | A | 9/1991 | Endoh et al. |
| 5,154,411 | A | 10/1992 | Saito et al. |
| 5,191,382 | A | 3/1993 | Okamura et al. |
| 5,298,959 | A | 3/1994 | Saito et al. |
| 5,580,042 | A | 12/1996 | Taniguro et al. |

(Continued)

FOREIGN PATENT DOCUMENTS

| | | | | |
|---|---|---|---|---|
| EP | 2014588 | A2 * | 1/2009 | ..... B65H 1/04 |
| JP | 04173626 | A * | 6/1992 | |

(Continued)

*Primary Examiner* — Luis A Gonzalez
(74) *Attorney, Agent, or Firm* — Venable LLP

(57) ABSTRACT

An image forming apparatus includes a first supporting member supporting a long sheet, a feeding unit for feeding the long sheet supported by the first supporting member with respect to a feeding direction and a second supporting member, rotatable about a rotational shaft, for supporting the long sheet with the first supporting member. In a state in which the sheet is bent so that a first portion of the long sheet is supported by the first supporting member and a second portion which is a more rear side than the first portion is positioned above the first portion, the second supporting member is movable between a first position where the second supporting member supports the second portion of the sheet and a second position where the center of gravity of the second supporting member is positioned downstream of a rotational center with respect to the feeding direction and the second supporting member maintains an attitude thereof by its own weight.

9 Claims, 6 Drawing Sheets

(56) References Cited

U.S. PATENT DOCUMENTS 5,613,672 A * 3/1997 Tanaka ..... B41J 13/10 271/223
5,620,174 A 4/1997 Taniguro et al.
5,672,019 A 9/1997 Hiramatsu et al.
5,725,319 A 3/1998 Saito et al.
5,918,873 A 7/1999 Saito et al.
6,168,270 B1 1/2001 Saikawa et al.
6,305,682 B1 10/2001 Saito et al.
6,545,255 B2 4/2003 Sato et al.
6,741,815 B1 5/2004 Fujita et al.
6,834,177 B2 12/2004 Saito et al.
6,939,064 B2 9/2005 Kawaguchi et al.
6,954,608 B2 10/2005 Sekiguchi et al.
6,961,991 B2 11/2005 Fuseya et al.
6,963,718 B2 11/2005 Sekiguchi
7,009,158 B2 3/2006 Sekiguchi et al.
7,027,764 B2 4/2006 Sekiguchi et al.
7,069,640 B2 7/2006 Fuseya et al.
7,081,604 B2 7/2006 Sekiguchi
7,136,601 B2 11/2006 Akizuki et al.
7,641,188 B2 1/2010 Hiura et al.
7,900,909 B2 3/2011 Hiura et al.
7,992,865 B2 * 8/2011 Sugizaki ..... B65H 31/02 271/223
8,480,074 B2 7/2013 Ubayashi et al.
8,550,459 B2 10/2013 Sekiguchi et al.
8,602,409 B2 12/2013 Sekiguchi
8,844,923 B2 9/2014 Ota et al.
8,864,123 B2 10/2014 Kamiyama et al.
8,870,178 B2 10/2014 Taoka et al.
9,302,862 B2 4/2016 Taoka
9,540,192 B2 1/2017 Kannari
9,731,919 B2 8/2017 Saito
10,556,763 B2 2/2020 Taoka
10,775,730 B2 9/2020 Nakagawa
10,800,620 B2 10/2020 Kannari
2005/0220519 A1 * 10/2005 Mizuno ..... G03G 15/6514 399/392
2008/0112744 A1 5/2008 Saito
2008/0112745 A1 5/2008 Saito
2017/0015511 A1 * 1/2017 Suzuki ..... B65H 3/44
2017/0227911 A1 * 8/2017 Kuno ..... G03G 21/1633
2018/0281485 A1 * 10/2018 Ozeki ..... B41J 13/103
2019/0062082 A1 2/2019 Murata
2020/0339367 A1 10/2020 Tamura et al.
2020/0354177 A1 11/2020 Nakagawa

FOREIGN PATENT DOCUMENTS

JP 2007031093 A * 2/2007
JP 2015098404 A * 5/2015

* cited by examiner

IMAGE FORMING APPARATUS

FIELD OF THE INVENTION AND RELATED ART

The present invention relates to an image forming apparatus for forming an image on a long sheet of recording medium.

It sometimes occurs that a sheet of recording medium which is longer than a sheet of recording medium of the standard size, in terms of the sheet conveyance direction, is used by an image forming apparatus such as an electrophotographic printer. There is disclosed in U.S. Patent No. 2019-0062082, an image forming apparatus structured so that in a case where a sheet of recording medium which is longer than a sheet of recording medium of the standard size is set in its manual feeder tray, the sheet can be bent in such a manner that it extends into the space above the manual feeder tray, and the trailing edge portion of the sheet is supported by the tray for the trailing edge of sheet, which is positioned above the manual feeder tray.

In the case of the image forming apparatus structured as disclosed in U.S. Patent No. 2019-0062082, it is possible that when a user places the leading edge portion of a sheet of recording medium which is longer than a sheet of recording medium of the standard size, in the manual feeder tray, the trailing edge supporting tray of the apparatus will interfere. Hereinafter, a sheet of recording medium of the standard size will be referred to as a standard sheet of recording medium, and a sheet of recording medium which is longer than a standard sheet of recording medium will be referred to as a long sheet of recording medium.

SUMMARY OF THE INVENTION

The primary object of the present invention is to provide a sheet feeding apparatus which is substantially superior in the efficiency with which a long sheet of recording medium can be set in the apparatus, to any conventional sheet feeding apparatus, and also, to provide an image forming apparatus equipped with such a sheet feeding apparatus.

According to an aspect of the present invention, there is provided an image forming apparatus comprising: a casing configured to accommodate an image forming unit forming an image on a sheet; a manual feeder tray provided on a side portion of said casing and configured to support the sheet; a trailing edge supporting member provided above said manual feeder tray with respect to a vertical direction, said trailing edge supporting member being used in a case in which a long sheet longer than a standard size sheet is placed on said manual feeder tray and said trailing edge supporting member supporting a trailing edge portion of the long sheet of which a leading edge portion is supported by said manual feeder tray; and a feeding unit configured to feed the long sheet, of which the leading edge portion is supported by said manual feeder tray and the trailing edge portion is supported by said trailing edge supporting member, toward said image forming unit in a feeding direction, wherein said trailing edge supporting member is configured to rotate about a shaft extending in a sheet width direction perpendicular to the feeding direction as a rotational center between a usage position and a retraction position, wherein the usage position is a position where the long sheet to be used is supported and a center of gravity of said trailing supporting member is apart from said image forming unit than the rotational center with respect to a horizontal direction perpendicular to the vertical direction and the sheet width direction, and wherein the retraction position is a position where said trailing supporting member is retracted when the long sheet to be used is placed on said manual feed tray and the center of gravity of said trailing supporting member is in a side of said image forming unit than the rotational center with respect to the horizontal direction and said trailing edge supporting member maintains an attitude thereof by its own weight.

Further features of the present invention will become apparent from the following description of exemplary embodiments (with reference to the attached drawings).

Figure 3:
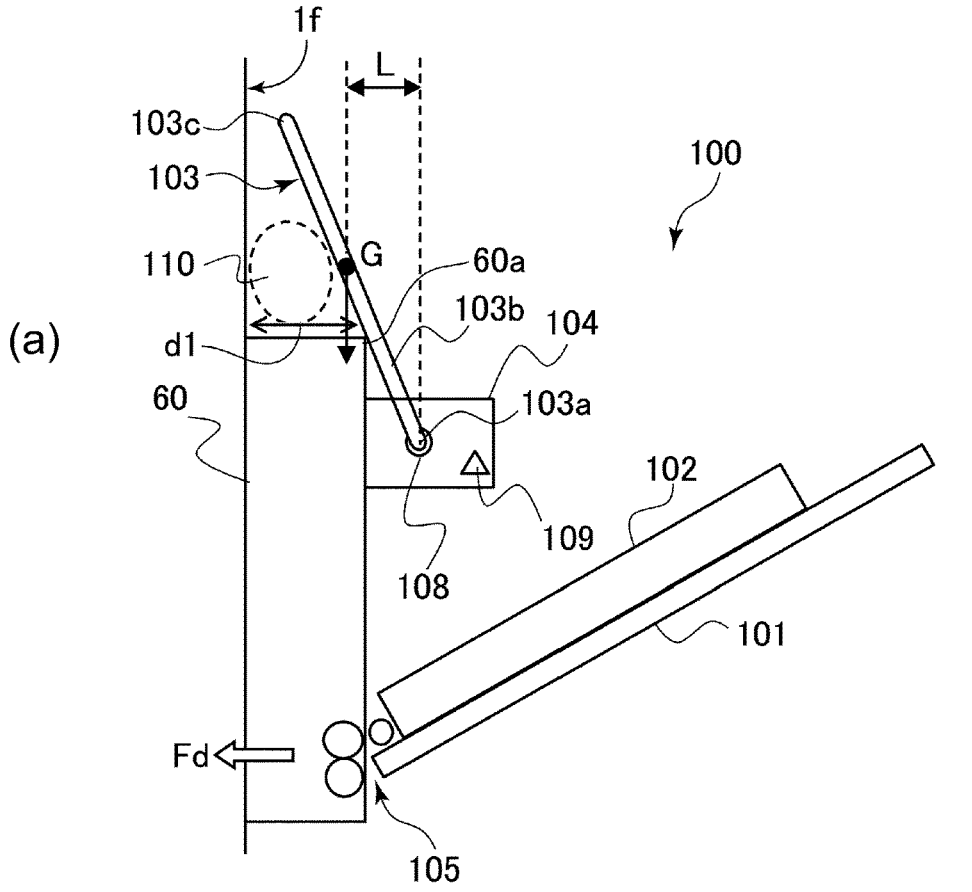
Figure 3:
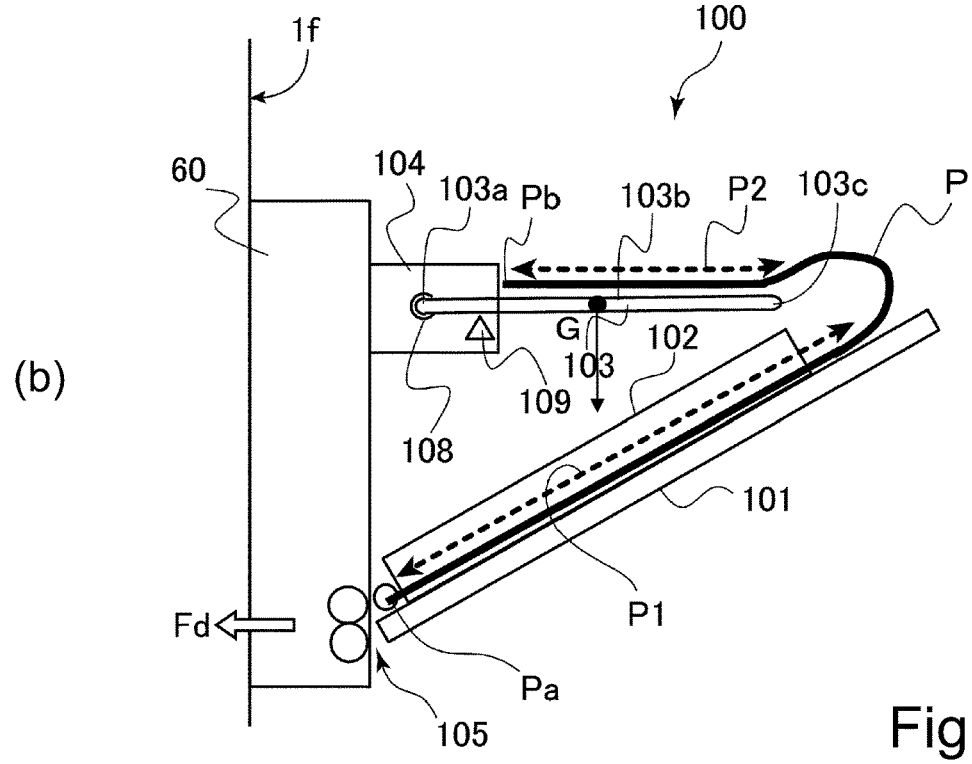

Parts (a) and (b) of FIG. 3 are drawings for describing the manual sheet feeding portion in the first embodiment, about its structure and operation.

Figure 4:
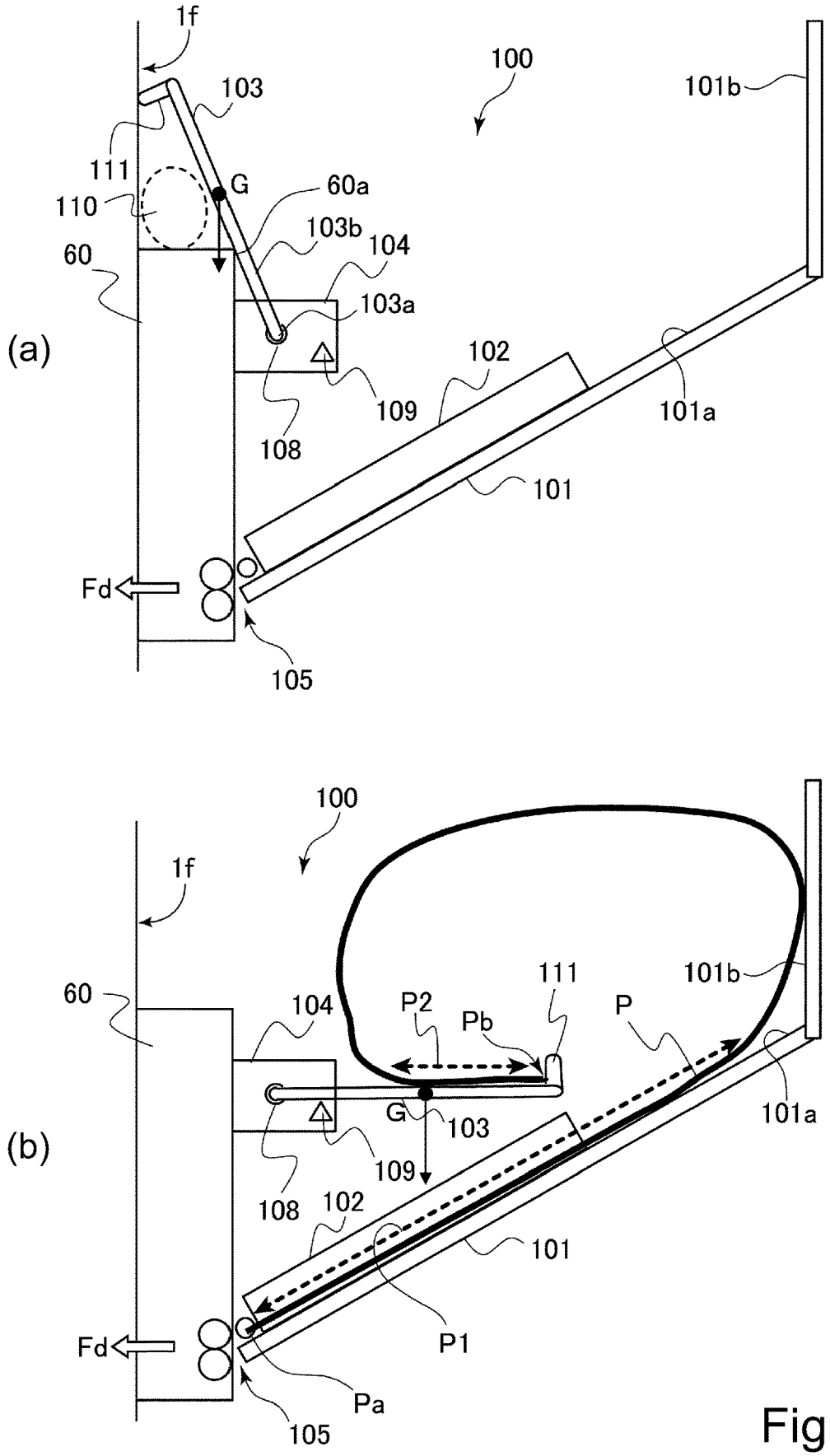

Parts (a) and (b) of FIG. 4 are drawings for describing the first of the modified versions of the manual sheet feeding portion in the first embodiment, about its structure and operation.

Figure 5:
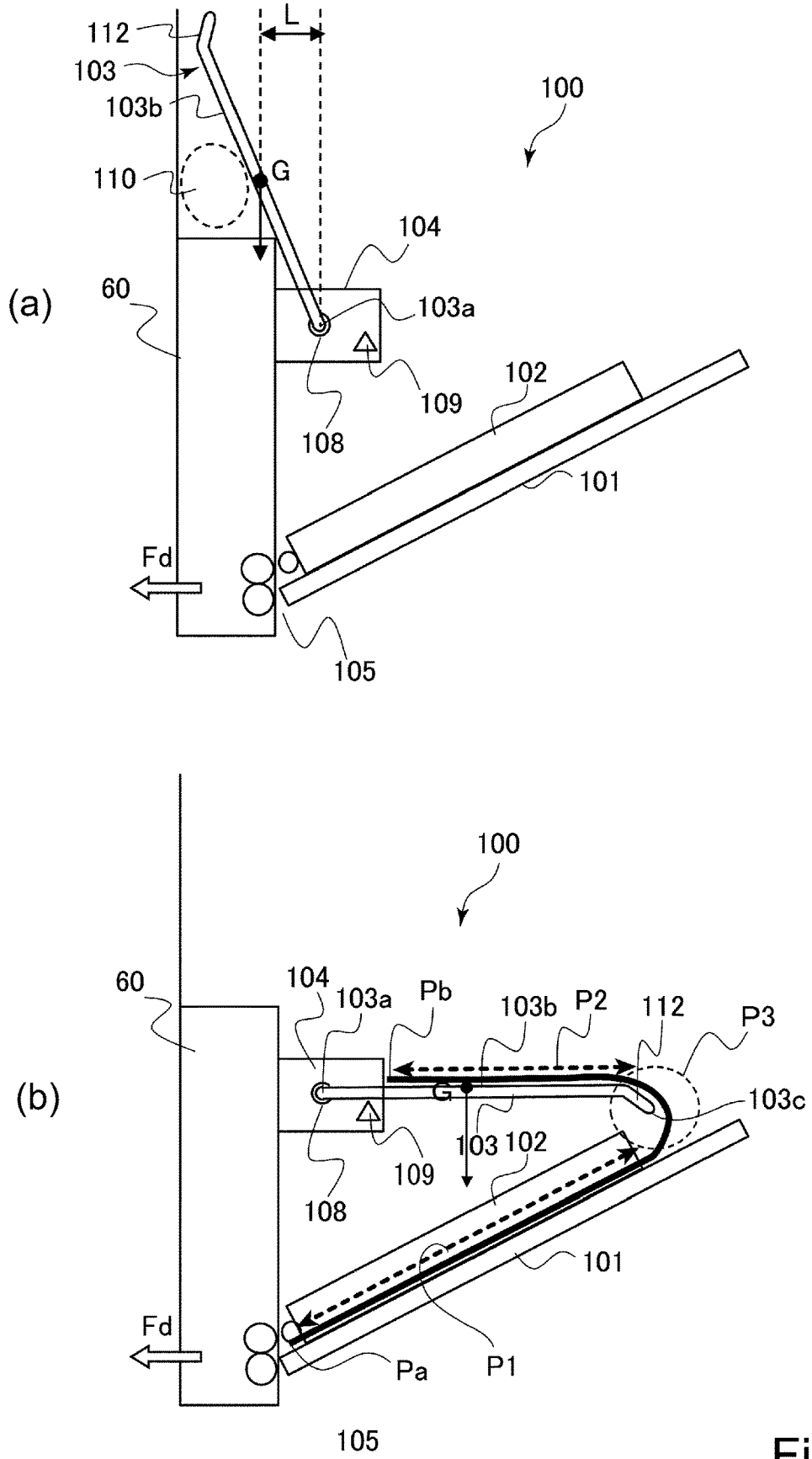

Parts (a) and (b) of FIG. 5 are drawings for describing the second of the modified versions of the manual sheet feeding portion in the first embodiment, about its structure and operation.

Figure 6:
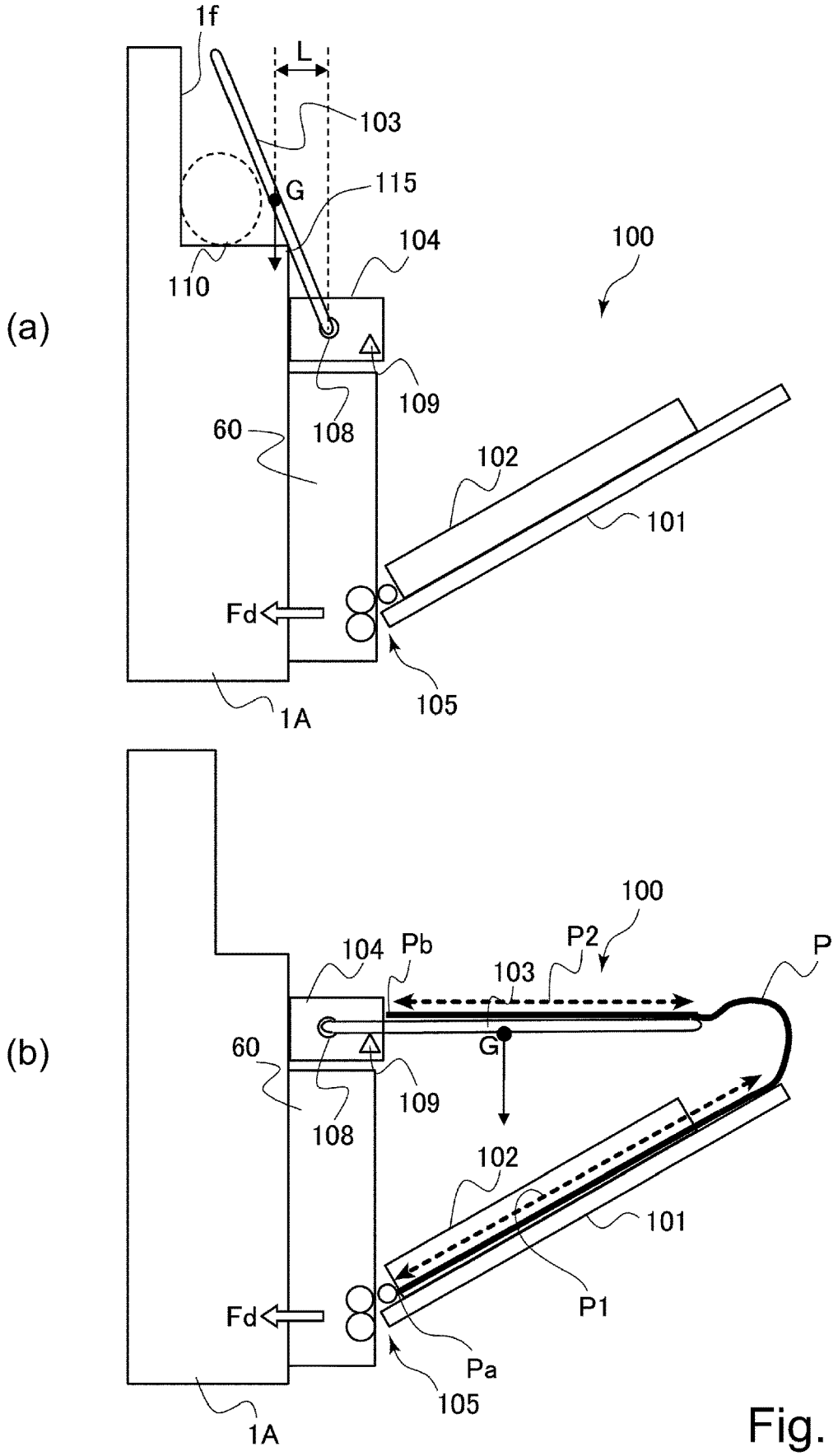

Parts (a) and (b) of FIG. 6 are drawings for describing the manual sheet feeding portion in the second embodiment of the present invention, about its structure and operation.

DESCRIPTION OF THE EMBODIMENTS

Hereinafter, the present invention is described with reference to preferred embodiments of the present invention, and appended drawings.

Embodiment 1

Figure 1:
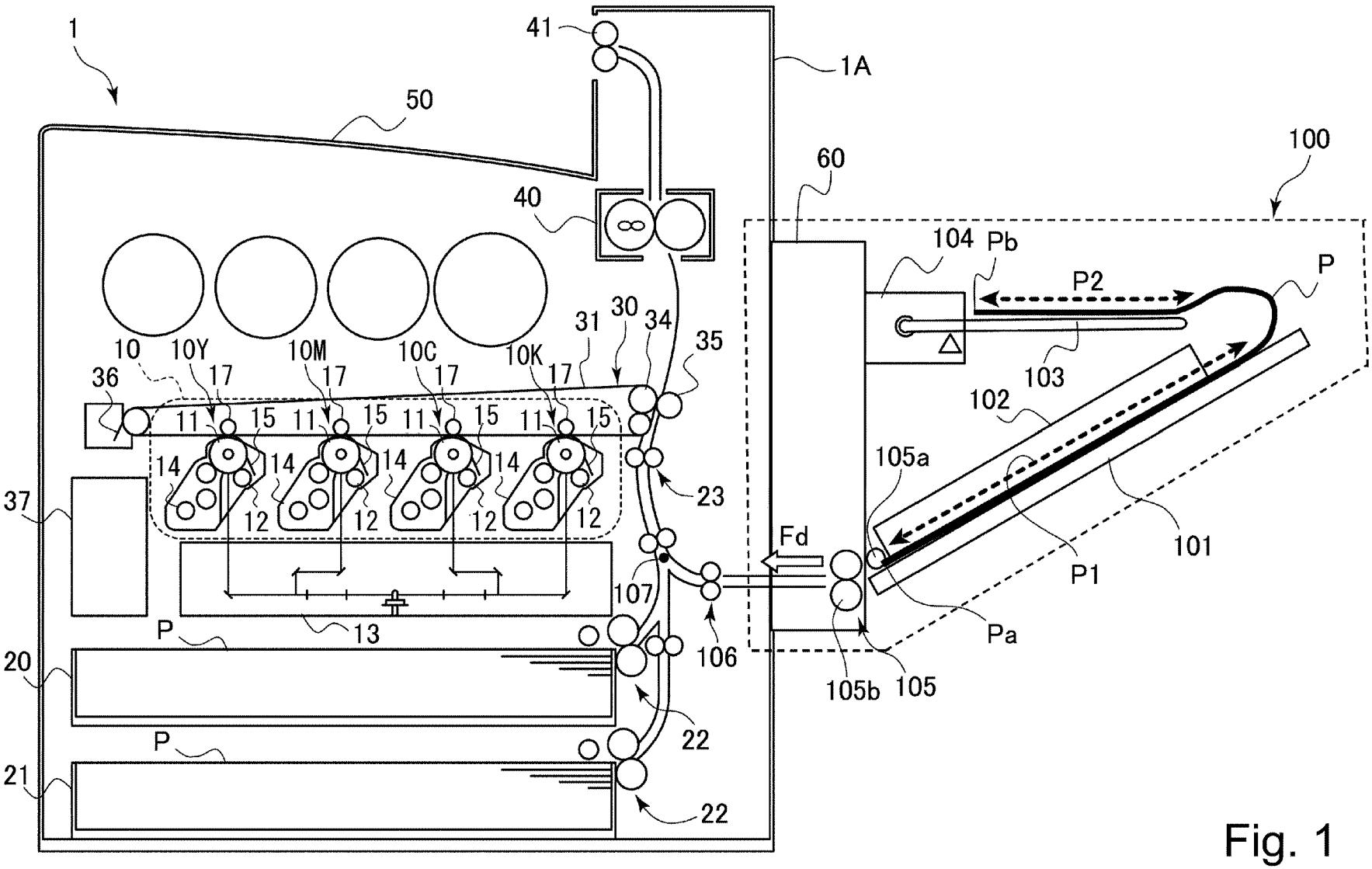
FIG. 1 is a schematic sectional view of the image forming apparatus in the first embodiment of the present invention.

To begin with, the image forming apparatus 1 in the first embodiment of the present invention is described with reference to FIGS. 1-3. FIG. 1 is a schematic sectional view of the image forming apparatus 1. The image forming apparatus 1 is a printer which has an electrophotographic image forming portion 10 as an image forming means, and a main assembly 1A. By the way, the "image forming apparatus" includes a copying machine, a multifunction machine, etc., in addition to a printer.

The image forming portion 10 has image formation units 10Y, 10M, 10C and 10K which form Y (yellow), M (magenta), cyan (C) and B (black) toner images, respectively, and a transfer unit 30 as a transferring means. The image forming portion 10 forms an image on a sheet P of recording medium by forming a toner image with the use of the image formation units 10Y-10K, based on the image information inputted from an external information device by way of a network, and transferring the toner image onto a sheet P of recording medium by way of the transferring unit 30. Recording medium includes such paper as ordinary paper and cardstock, plastic film such as the one for an overhead projector, an envelope, index paper, and the like, which are specific in shape, fabric, etc. That is, it includes sheets of various materials, which are different in size, surface treatment, and the like properties.

The image formation units 10Y-10K are the same in structure although they are different in the color of the toner they use for development. Thus, their structure is described with reference to the yellow image formation unit 10Y. The image formation unit 10Y has a photosensitive drum 11 which is a drum-shaped electrophotographic photosensitive member, a charging device 12 as a charging means, a development device 14 as a developing means, and a drum cleaner 15 as a cleaning means. As an image formation start command is given to the image forming portion 10, the photosensitive drum 11 rotates, and the charging device 12 uniformly charges the peripheral surface of the photosensitive drum 11. A laser scanner 13, as an exposing means, which is below the image forming portion 10, projects a beam of laser light upon the peripheral surface of the photosensitive drum 11, while modulating the beam with the information of the image to be formed. As a result, an electrostatic latent image is written on the peripheral surface of the photosensitive drum 11. This electrostatic latent image is developed by the yellow toner which is supplied from the development device 14. Consequently, a yellow toner image is formed on the peripheral surface of the photosensitive drum 11. The above described process is carried out in each of the image formation unit 10Y-10K at the same time. As a result, yellow, magenta, cyan, and black toner images are formed on the peripheral surfaces of the photosensitive drums 11Y-11K, respectively.

The toner image borne by each photosensitive drum 11 is transferred (primary transfer) onto an intermediary transfer belt 31 by primary transfer rollers 17. More specifically, the four toner images, which are different in color, are transferred onto the intermediary transfer belt 31 in such a manner that they overlap. Consequently, a full-color toner image is effected on the intermediary transfer belt 31. The adherent residues such as the transfer residual toner, that is, the toner which failed to be transferred onto the intermediary transfer belt 31, and therefore, is remaining on the photosensitive drum 11, are removed by a drum cleaner 15. The intermediary transfer belt 31 is suspended and tensioned by multiple rollers, which include a second transfer inside roller 34. It conveys the toner image by rotating in a preset direction which is compliant to the rotational direction of the photosensitive drum 11.

In parallel to the progression of the electrophotographic process described above, the image forming apparatus 1 feeds sheets P of recording medium, one by one, into its main assembly 1A, from a sheet feeder cassette 20, a sheet feeder cassette 21, or a manual sheet feeder portion 100. The image forming apparatus 1 is structured so that the sheet feeder cassettes 20 and 21 are removably installable in the main assembly 1A of the apparatus 1 (which hereafter will be referred to as apparatus main assembly 1A). They are primarily used to store sheets P of recording medium, which are standard in size (size A3, for example). The manual feeder portion 100 is usable for feeding various sheets of recording medium in terms of size, shape, etc. For example, it can be used to feed not only a sheet P of recording medium, which is standard in size, but also a sheet P of recording medium, which is longer in terms of the sheet conveyance direction than a sheet P of recording medium of the standard size. The manual feeding portion 100 will be described later.

The apparatus main assembly 1A is provided with a pair of feeding units 22 and 23, which are correspondent to the feeder cassettes 20 and 21, respectively. The feeder unit 22 has a pickup roller for moving a sheet P of recording medium out of the feeder cassette 20 or 21, and a separation roller pair for catching the sheet P from the pickup roller and conveys it further. The separation roller pair has a conveyance roller which conveys the sheet P in the same direction as the pickup roller, and a separation roller which is disposed in contact with the conveyance roller to separate the topmost sheet P from the rest, in the nip between the conveyance roller and separation roller, with the utilization of friction. As sheets P of recording medium are moved, one by one, out of the nip of the separation roller pair, each sheet P is conveyed toward a registration roller pair 23 by way of a conveyance passage in the apparatus main assembly 1A.

As the leading edge of a sheet P of recording medium collides with the registration roller pair 23, which is remaining stationary, it conforms in attitude to the nip of the registration roller pair 23. Thus, the sheet P is positioned so that its leading edge becomes perpendicular to the sheet conveyance direction. Thereafter, the registration roller pair 23 sends the sheet P into the secondary transferring portion, in synchronism with the progression of the image forming operation in the image forming portion 10.

The secondary transferring portion is a nip formed between a secondary transfer roller 35 which faces the secondary transfer inner roller 34, with the presence of the intermediary transfer belt 31 between the two rollers 35 and 34. The toner image on the intermediary transfer belt 31 is transferred (secondary transfer) onto a sheet P of recording medium by the bias (electric field) which the secondary transfer roller 35 forms, in the secondary transferring portion. Adherent residues such as transfer residual toner on the intermediary transfer belt 31, that is, the toner which failed to be transferred onto the sheet P, and therefore, remaining on the secondary transfer roller 35, are removed by the drum cleaner 15, and then, are recovered into a recovery residue container 37.

After being moved through the secondary transferring portion, the sheet P is sent to a fixing device 40 as a fixing means. The fixing device 40 has a fixation roller pair which conveys the sheet P by holding the sheet P in its nip while applying pressure to the sheet P, and a heating means such as a halogen lamp, ceramic heater, or the like for heating the toner image on the sheet P. It heats and presses the toner image. Thus, the toner of the toner image melts, and then, sticks to the sheet P as it cools down. As a result, a print, that is, a sheet P of recording medium which has a fixed image, is obtained. After being conveyed through the fixing device 40, the sheet P is discharged from the apparatus main assembly 1A by a discharge roller pair 41 into a delivery tray 50 in such a manner that it lays itself on the topmost sheet P in the tray 50.

By the way, the image forming portion 10 described above is an example of an image forming means. An inkjet printing unit, or printing mechanism of an offset printing unit, may be used as the image forming means.

[Manual Feeding Portion]

The manual feeding portion 100 in this embodiment, which is a sheet feeding apparatus, is attached to one (one of side surfaces of apparatus main assembly 1A in terms of horizontal direction as image forming apparatus is seen from direction parallel to primary scan direction when an image is formed, as indicated in FIG. 1). The manual feeding portion 100 includes a door 60, a feeding unit 105, a manual feeder tray 101, and a trailing edge portion supporting tray 103. The feeding unit 105 is a feeding means in this embodiment. The manual feeder tray 101 is a supporting member in this embodiment, and the trailing edge portion supporting tray is the second supporting member in this embodiment. Hereinafter, the direction (leftward in FIG. 1)

in which a sheet P of recording medium is fed into the apparatus main assembly 1A is referred to as "sheet feeding direction Fd". Unless specifically noted, the sheet feeding direction Fd means the horizontal direction, which is perpendicular to the vertical direction and the direction perpendicular to the sheet width direction.

The manual feeder door 60 is such a door that is supported by the apparatus main assembly 1A in such a manner that it can be opened or closed. The manual feeder tray 101 is supported by the apparatus main assembly 1A, with the presence of the manual feeder door 60 between itself and apparatus main assembly 1A. It is protrusive upstream from the apparatus main assembly 1A in terms of the sheet feeding direction Fd (leftward in FIG. 1). The top surface of the manual feeder tray 101 is a supporting portion for supporting a sheet P of recording medium. It is positioned so that, in terms of the sheet feeding direction Fd, it is downwardly tilted (inclined). The manual feeder tray 101 is provided with a pair of side regulating plates 102, which oppose each other in terms of the widthwise direction of the sheet P. The pair of side regulating plates 102 are means for regulating a sheet P of recording medium in position in terms of the sheet width direction (depth direction of FIG. 1), which is perpendicular to the sheet feeding direction Fd, by coming into contact with the corresponding edges of the sheet P. Each of the pair of side regulating plates has a regulating surface, which is protrusive upward from the manual feeder tray 101 and extends in the sheet feeding direction Fd. The side regulating plate 102 is positioned so that its regulating surface is placed in contact with the corresponding lateral edge of the sheet P, preventing the sheet P from being placed askew while it is set in the manual feeder tray 101, and also, to preventing the sheet P from becoming askew while being fed.

The sheet feeding unit 105 has: a pickup roller 105*a* for moving a sheet P of recording medium out of the manual feeder tray 101; and a separation roller pair 105 for catching the sheet P from the pickup roller 105*a* and conveys it further. The pickup roller 105*a* starts feeding a sheet P, by rotating while remaining in contact with the top surface of the topmost sheets P on the manual feeder tray 101. The separation roller pair 105*b* has: a conveyance roller which conveys the sheet P in the same direction as the pickup roller 105*a*; a separation roller which is disposed in contact with the conveyance roller and frictionally separates the other sheets P than the topmost sheet P from the topmost sheet, in the nip between the conveyance roller and separation roller. By the way, the sheet feeding unit 105 is an example of means for feeding a sheet P into the main assembly 1A of the image forming apparatus 1. It may be replaced with a sheet feeding unit which does not have a pickup roller, and which is structured so that a conveyance roller moves the sheet P out of the manual feeder tray 101 by coming into contact with a sheet P on the manual feeder tray 101. Further, the separation roller is an example of separating member which separates the topmost sheet P from the rest in the manual feeder tray 101. It may be replaced by an elastic member which is in the form of a pad.

As a sheet P of recording medium is conveyed further into the apparatus main assembly 1A from the separation roller pair 105*b*, it is conveyed to a sheet pulling roller pair 106 which is in the apparatus main assembly 1A, by way of the opening of the apparatus main assembly 1A. The sheet conveyance path from the sheet feeding cassettes 20 and 21, and the sheet conveyance path from the manual feeder tray 101, merge at a merging point 107, which is on the downstream side of the pulling roller pair 106, in terms of sheet feeding direction Fd. Therefore, as a sheet P of recording medium is fed from the manual feeding portion 100, and then, is conveyed further downstream by the pulling roller pair 106, it is conveyed toward the registration roller pair 23 by way of the merge point 107.

The trailing edge supporting tray 103 is positioned above the manual feeder tray 101 and side regulating plates 102. It is attached to one of the side surfaces of the apparatus main assembly 1A. It is enabled to move into a usage position (first position) shown in FIG. 1, and a retraction position (second position), which will be described later.

Referring to FIG. 1, when the trailing edge supporting tray 103 is in its usage position, it is protrusive upstream from the apparatus main assembly 1A in terms of the sheet conveyance direction Fd. That is, the usage position of the trailing edge supporting tray 103 is such a position that when the trailing edge supporting tray 103 is in the usage position, it vertically overlaps with the manual feeder tray 101. The usage position is such a position that when the trailing edge supporting tray 103 is in the usage position, the trailing edge supporting tray 103 supports a long sheet P of recording medium, and also, that, the center of gravity of the trailing edge supporting tray 103 is farther away from the image forming portion 10, in terms of the horizontal direction, that is, the direction which is perpendicular to the sheet width direction. Further, when the trailing edge supporting tray 103 is in its usage position, the top surface (ridges on top side), if surface is not flat) of the trailing edge supporting tray 103 function as the second supporting portions, whereas the top surface of the manual feeder tray 101 functions as the first supporting portion.

The manual feeding portion 100 in this embodiment is structured so that in a case where a long sheet P of recording medium, that is, a sheet of recording medium which is longer than a sheet of recording medium of the standard length, is set (placed) in the manual feeding portion 100, the sheet P is supported by both the manual feeder tray 101 and trailing edge supporting tray 103, with the sheet P remaining bent backward in curvature as shown in FIG. 1. That is, after the setting of a long sheet P of recording medium in the manual feeding portion 100, the leading portion P1 of the long sheet P, that is, the portion of the long sheet P, which is on the leading edge Pa side, is supported by the manual feeder tray 101, whereas, the trailing portion P2 of the long sheet P, that is, the portion (second portion) of the long sheet P, which is on the trailing edge Pb side is supported by the trailing edge supporting tray 103 in its usage position.

Here, among the edges (peripheral portions) of a sheet P of recording medium, the "leading edge Pa" of the sheet P means the edge of the sheet P, which is at the front when the sheet P is fed into the apparatus main assembly 1A by the sheet feeding unit 105. The trailing edge Pb of the sheet P means the opposite edge of the sheet P from the leading edge Pa. In other words, in a case where the sheet P is fed into the apparatus main assembly 1A from the manual feeding portion 100, the leading portion P1 is moved into the sheet conveyance path in the apparatus main assembly 1A, ahead of the trailing portion P2. By the way, the positional relationship between the leading portion P1 and trailing portion P2 is relative. There is no requirement regarding the ratio in size between the leading portion P1 and trailing portion P2.

In this embodiment, in a case where a long sheet P of recording medium is set in the manual feeding portion 100, the sheet P is set in such a manner that the leading portion P1 of the sheet P is supported by the manual feeder tray 101, and the trailing portion P2 is supported by the trailing edge supporting tray 103. That is, it is set as if it is bent in the shape of a letter U. Hereafter, the surface (downwardly facing surface) of the sheet P, by which the sheet P is supported by the manual feeder tray 101 is referred to as the first surface. Thus, the trailing edge supporting tray 103 supports the sheet P by the opposite surface of the sheet P from the first surface.

Since the manual feeding portion 100 is structured so that the trailing edge of a long sheet P of recording medium is supported by the trailing edge supporting tray 103, it can reliably feed even a long sheet P of recording medium into the apparatus main assembly 1A. That is, for example, if the trailing portion P2 of a long sheet P is hanging down from the right side (FIG. 1) of the manual feeder tray 101, it is possible that the sheet P will fall or, move askew. Further, it is possible that while the sheet P is fed into the apparatus main assembly 1A, it will come into contact with the edge of the manual feeder tray 101, which in turn will cause feeding failure like a jam. In this embodiment, however, the sheet feeding apparatus is structured so that the trailing portion P2 of the long sheet P is supported by the trailing edge supporting tray 103. Therefore, the apparatus is stable in the attitude of a long sheet of recording medium while the sheet P is set in manual feeding portion 10, and being fed into the apparatus main assembly 1A. Therefore, the problems such as those described above are unlikely to occur.

[Sheet Movement when a Long Sheet is Set]

Figure 2:
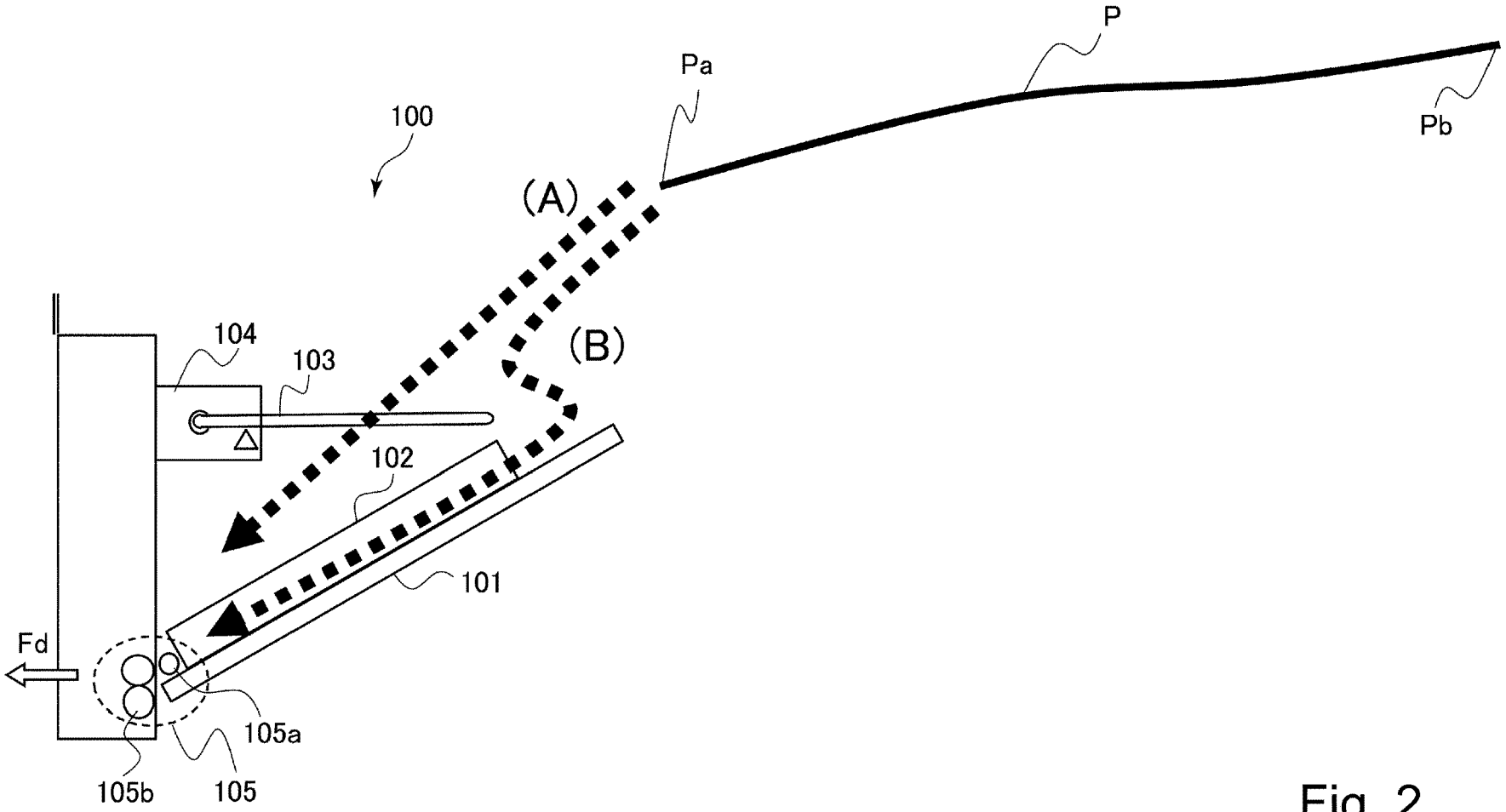
FIG. 2 is a drawing for describing the operation to set a long sheet of recording medium in the manual sheet feeding portion of the image forming apparatus, in the first embodiment.

Next, referring to FIG. 2, the positional relationship between the typical line of movement of a sheet P of recording medium, and the trailing edge supporting tray 103, which occurs when the sheet P is set in the manual feeding portion 100, is described. The lines A and B of movement of a sheet P of recording medium represent typical lines, one for one, of movement of the leading edge Pa of the sheet P, which occurs in a case where a user tries to set a long sheet P of recording medium in the manual feeder tray 101 while the trailing edge supporting tray 103 is in its usage position. Ordinarily, a user tries to set the long sheet P in the manual feeder tray 101 from the diagonally upward and upstream side of the manual feeder tray 101 in terms of the sheet feeding direction Fd, in such a manner that the leading edge Pa of the sheet P reaches a preset position. The "preset position" means a position which is preset to ensure that the leading portion of the sheet P comes into contact with the sheet feeding unit 105 so that a sheet feeding operation can be started. In terms of the sheet feeding direction Fd, it is on the downstream side of the point of contact between the pickup roller 105*a* and sheet P.

By the way, as an example of structural arrangement to position a sheet P of recording medium relative to the manual feeder tray 101 (sheet position regulating means), it is possible to provide the upstream side of the manual feeder tray 101, in terms of the sheet feeding direction Fd, with a blocking wall. However, a shutter may be positioned between the pickup roller 105*a* and separation roller 105*b* in such a manner that in a case where the sheet feeding unit 105 is not used for a sheet feeding operation, the shutter is held in the aforementioned preset position, so that the leading edge Pa of the sheet P comes into contact with the shutter. In such a case, the sheet feeding portion 100 is structured so that while sheets P of recording medium are fed into the apparatus main assembly 1A, the shutter remains retracted from the sheet passage.

When the trailing edge supporting tray 103 is in its usage position, it is above the manual feeder tray 101. Therefore, it sometimes occurs that as a user tries to set the leading edge Pa of the sheet P in the manual feeder tray 101, through the shortest path, the line (A) of movement of the sheet P sometimes intersects with the trailing edge supporting tray 103. Thus, in a case where the manual feeder tray 101 is structured so that the trailing edge supporting tray 103 is immovable, a user is forced to set the sheet P through the narrow space between the trailing edge supporting tray 103 and manual feeder tray 101 in terms of the vertical direction, as indicated by the line (B) of movement of the leading edge Pa. Thus, each time a user tries to set a long sheet of recording medium in the manual feeder tray 101, the user has to set the sheet P while paying attention to where the leading edge Pa is. Thus, it has been desired to improve a manual feeder tray 101 in operability (operational efficiency).

Thus, in this embodiment, the manual feeding portion 100 is structured so that the trailing edge supporting tray 103 is pivotally movable to improve the manual feeding portion 100 in operability. Next, referring to FIGS. 3(*a, b*), the trailing edge supporting tray 103 in this embodiment is described in detail.

The trailing edge supporting tray 103 in this embodiment is pivotally held to a tray holding portion 104 fixed to the apparatus main assembly 1A. The trailing edge supporting tray 103 is formed of metallic wire. Metallic wire (which sometimes is referred to as core material) means fine and long rod. For example, long, narrow, and cylindrical stainless steel rod may be used. Further, the metallic rod may be hollow (cylindrical).

The trailing edge supporting tray 103 is desired to be formed of a single piece of metallic wire (rod). It is bent in such a manner that the lengthwise end portions serve as rotational axles 3*a*, and the portion of the metallic rod, which is between the lengthwise end portions serves as the supporting portion 103*b* which supports sheets P of recording medium. In this case, each rotational axle 103*a* is parallel to the sheet width direction. It is rotatably fitted in a bearing hole 108, with which the tray holding portion 104 is provided. The supporting portion 103*a* is made up of multiple pieces of straight rod which are parallel to the sheet feeding direction Fd, and multiple roughly U-shaped pieces of rod, which are in connection to the adjacent straight piece of rod, by their ends, forming a virtual surface for supporting the sheets P.

The sheet feeding portion 100 is structured so that the trailing edge supporting tray 103 is enabled to be moved into the retraction position shown in FIG. 3(*a*), and the usage position shown in FIG. 3(*b*). The usage position is for enabling the trailing edge supporting tray 103 to support the trailing portion P2 of a long sheet P. The retraction position is a position into which the trailing edge supporting tray 103 can be upwardly pivoted from the usage position. The retraction position is for accommodating the trailing edge supporting tray 103 when a long sheet P is mounted in the aforementioned manual feeding portion 100. It is such a position that when the trailing edge supporting tray 103 is this position, the center of gravity of the trailing edge supporting tray 103 will be closer to the image forming portion 10 than its pivot, in terms of the horizontal direction.

When the trailing edge supporting tray 103 is in its usage position, its leading portion, which is farther from the rotational axle 103*a* in terms of the sheet feeding direction Fd is in the space which is on the upstream side of the rotational axle 103*a*, and also, is above the manual feeder tray 101, protruding in the space above the manual feeder tray 101 (FIG. 3(*b*)). On the other hand, when the trailing edge supporting tray 103 is in its retraction position, its leading edge portion 103*c* is in such a space that is on the upstream side of the rotational axle 103*a* in terms of the sheet feeding direction Fd, and on the downstream side in terms of the sheet feeding direction Fd.

The tray holding portion 104 is provided with an engaging portion 109, which is for keeping the trailing edge supporting tray 103 in its usage portion. The engaging portion 109 is positioned upstream of the rotational axle 103*a* in terms of the sheet feeding direction Fd, for example. It is protrusive from the tray holding portion 104, and is positioned so that it overlaps with the trailing edge supporting tray 103 when the trailing edge supporting tray 103 is in its usage position.

Referring to FIG. 3(*b*), when the trailing edge supporting tray 103 is in its usage position, the engaging portion 109, which is the first holding portion, supports the trailing edge supporting tray 103 by the bottom surface of the trailing edge supporting tray 103. That is, when the sheet feeding portion 100 is in the state shown in FIG. 3(*b*), the center of gravity of the trailing edge supporting tray 103 is on the upstream side of the rotational axle 103*a* in terms of the sheet feeding direction Fd. Thus the gravity which acts on the trailing edge supporting tray 103 generates such moment that works in the direction to cause the trailing edge supporting tray 103 to pivot in the clockwise direction of the drawing about the rotational axle 103*a*. The engaging portion 109 holds the trailing edge supporting tray 103 in its usage position by regulating the trailing edge supporting tray 103 in pivotal movement against the above described moment.

On the other hand, as the trailing edge supporting tray 103 is pivoted in the counterclockwise direction of the drawing, from the usage position, into the retraction position as shown in FIG. 3(*a*), the trailing edge supporting tray 103 comes into contact with a tray rest 60*a*, with which the top portion of the door 60 is provided. Thus, the trailing edge supporting tray 103 is held in its retraction position. That is, in terms of the sheet feeding direction Fd, the center G of gravity of the trailing edge supporting tray 103 is on the downstream side of the rotational axle 103*a* by a distance L. Thus, it generates such moment in the trailing edge supporting tray 103 that works in the direction to cause the trailing edge supporting tray 103 to pivot in the counterclockwise direction of the drawing, about the rotational axle 103*a*. A tray rest 60*a*, which is the second holding portion, keeps the trailing edge supporting tray 103 in the retraction position by regulating the trailing edge supporting tray 103 in the pivotal movement against the above described moment.

As described, the sheet feeding portion 100 is structured so that the trailing edge supporting tray 103 can be retracted from the usage position to the retraction position, and also, the trailing edge supporting tray 103 is retained in the retraction position by its own weight. Thus, the sheet feeding portion 100 in this embodiment is superior to any conventional one in terms of ease (efficiency) with which a long sheet P of recording medium can be set therein. That is, when a user wants to set a long sheet P of recording medium in the manual feeder tray 101, the user can flip the trailing edge supporting tray 103 up into the retraction position before the user places the leading portion P1 of the long sheet P in the manual feeder tray 101. Therefore, the movement of the leading edge Pa of the sheet P is unlikely to be interfered by the trailing edge supporting tray 103. Thus, the user can easily place the leading portion P1 of the long sheet P in the manual feeder tray 101. Thereafter, the user is to make the trailing edge supporting tray 103 pivot back into the usage position, and bend the long sheet P so that the trailing portion P2 of the long sheet P rests on the trailing edge supporting tray 103, to end the operation to set the long sheet P in the sheet feeding portion 100.

By the way, in a case where a user wants to feed the image forming apparatus 1 with a sheet P of recording medium, which can be supported in entirety (in terms of length) by the manual feeder tray 101, all that the user has to do is to place the sheet P in the manual feeder tray 101, while keeping the trailing edge supporting tray 103 in the retraction position. Also in this case, the fact that the trailing edge supporting tray 103 is remaining in the retraction position contributes to the improvement of the sheet feeding portion 100 in the efficiency with which a sheet P of recording medium can be set in the sheet feeding portion 100.

By the way, in this embodiment, the sheet feeding portion 100 is structured to ensure that when the trailing edge supporting tray 103 is in its retraction position (FIG. 3(*a*)), there is an operational space 110 between the trailing edge supporting tray 103 and the adjacent surface of the apparatus main assembly 1A. The operation space 110 is for allowing a user to insert his or her hand between the trailing edge supporting tray 103 and the apparatus main assembly 1A to push the trailing edge supporting tray 103 in the upstream direction, in terms of the sheet feeding direction Fd, to move the trailing edge supporting tray 103 from the retraction position into the usage position.

In other words, the operational space 110 which is large enough (as seen from the direction parallel to the sheet width direction) for a user to insert at least one of his or her fingers is provided between the trailing edge supporting tray 103 and side surface if of the apparatus main assembly 1A when the trailing edge supporting tray 103 is in the retraction position. In order to ensure that the operation space 110 is provided, the maximum width dl of the gap between the trailing edge supporting tray 103 and the side surface of the apparatus main assembly 1A, in terms of the sheet feeding direction Fd, is set to no less than 2 cm, preferably, no less than 3 cm. In this embodiment, the tray rest 60*a* (as second holding portion) is protrusive from the side surface if of the apparatus main assembly 1A. Therefore, the amount by which the tray rest 60*a* is protrusive from the side surface if is practically equal to the maximum width dl of the operational space 110. The provision of this operational space 110 makes it easier for a user to pivotally move the trailing edge supporting tray 103, further improving the sheet feeding portion 100 in the ease (efficiency) with which a sheet P of recording medium can be set in the sheet feeding portion 100.

(Modification 1)

In the case of the sheet feeding portion 100 in the first embodiment, when a long sheet P of recording medium is set in the sheet feeding portion 100, it is set so that its leading edge portion is supported by the manual feeder tray 101, and trailing edge supporting tray 103 is supported by the trailing edge supporting tray 103, that is, in such a manner that it is bent in the shape of a letter U. However, the sheet feeding portion 100 may be designed so that when a long sheet P of recording medium is set in the sheet feeding portion 100, it is bent in a different shape from the one in the first embodiment. For example, the sheet feeding portion 100 may be structured so that when a long sheet P of recording medium is set in the sheet feeding portion 100, its trailing edge portion P2 is made to upwardly curl backward, and the adjacencies of the trailing edge portion Pb, which is parallel to the sheet feeding direction Fd, is supported by the trailing edge supporting tray 103. In other words, the sheet P is bent in such a manner that the portion of the sheet P, which is between the first and second portions of the sheet P extends downstream in terms of the sheet feeding direction Fd, and the second portion extends rearward in the leading-edge-to-trailing-edge direction, that is, downstream in terms of the sheet feeding direction Fd. FIG. 4(*a*) shows the sheet feeding portion 100 when the trailing edge supporting tray 103 is in the retraction position, and FIG. 4(*b*) shows the sheet feeding portion 100 when the trailing edge supporting tray 103 is in the usage position.

In the case of the trailing edge supporting tray 103 in this modified version of the first embodiment, it is possible to provide the opposite edge portion of the trailing edge supporting tray 103 from the rotational axle 103*a*, with a sheet catching portion 111, which is upwardly protrusive when the trailing edge supporting tray 103 is in the state shown in FIG. 4(*b*). The sheet catching portion 111 prevents the trailing edge portion Pb of the sheet P from falling into the manual feeder tray 101 from the trailing edge supporting tray 103. Further, the manual feeder tray 101 may be shaped so that it has an auxiliary supporting surface 101*b* which is upwardly protrusive from the more upstream portion of the manual feeder tray 101 than the primary supporting surface 101*a*, in terms of the sheet feeding direction Fd, in addition to the primary supporting surface 101*a*. By the way, in this modified version of the first embodiment, the surface of a sheet P, by which the manual feeder tray 101 supports the sheet P is referred to as the first surface of the sheet P. Thus, the trailing edge supporting tray 103 also supports the sheet P by the first surface. Further, it is to be assumed here that the elements in FIGS. 4(*a*) and 4(*b*), which have the same referential code as the counterparts in the first embodiment, are practically the same in structure and function as the counterparts.

(Modification 2)

In the first embodiment, the trailing edge supporting tray 103 is roughly straight as seen from the sheet width direction. However, the trailing edge supporting tray 103 may be provided with a slant portion 112, which slants diagonally downward toward the manual feeder tray 101 from the trailing edge of the trailing edge supporting tray 103 as shown in FIGS. 5(*a, b*). FIG. 5(*a*) shows the trailing edge supporting tray 103 when the tray 103 is in the retraction position, and FIG. 5(*b*) shows the trailing edge supporting tray 103 when the tray 103 is in the usage position.

The slant portion 112 is such a portion of the trailing edge supporting tray 103 that downwardly (with reference to line drawn upstream in terms of sheet feeding direction Fd) slants upstream, in terms of the sheet feeding direction Fd, toward the supporting portion 103*b* of the trailing edge supporting tray 103. In other words, the slant portion 112 is angled relative to the supporting portion 103*b* of the trailing edge supporting tray 103, in such a manner that when it is seen from the sheet width direction while it is in the state shown in FIG. 5(*b*), the more upstream it is in terms of the sheet feeding direction Fd, the closer it is to the manual feeder tray 101, the elements of the sheet feeding portion 100, which are the same in referential code as the counterparts in the first embodiment in FIGS. 5(*a*) and 5(*b*) are practically the same in structure and function.

The slant portion 112 has such a function that prevents the occurrence of contact marks to a sheet P of recording medium, which is attributable to the friction which occurs as the sheet P rubs against the upstream edge of the trailing edge supporting tray 103 when the sheet P is fed into the apparatus main assembly 1A. That is, as a sheet P of recording medium is fed into the apparatus main assembly 1A by the sheet feeding unit 105, the bent portion P3 (portion between leading portion P1 and trailing portion P2, which is bent roughly in the form of a letter U), reduces in the amount of play. Thus, the sheet P is conveyed, while being made to remain firmly in contact with the leading portion 103*c* of the trailing edge supporting tray 103. Thus, if a sheet P of thin paper or the like, which is low in rigidity, is used as recording medium, the sheet P is made to be firmly in contact with the leading edge portion 103*c*, making it possible that contact marks will be on the sheet P. In comparison, in this version of modification of the first embodiment, the sheet P is guided by the slant portion 112. Therefore, the contact pressure between the sheet P and the leading edge 103*c* is spread across the slant portion 112. Therefore, the sheet P is unlikely to suffer from the contact marks.

By the way, in a case where the trailing edge supporting tray 103 is provided with a slanted portion such as the slant portion 112, when the trailing edge supporting tray 103 is in the usage position, the distance, in terms of the vertical direction, between the leading portion 103*c* of the trailing edge supporting tray 103 and the manual feeder tray 101, is smaller than in a case where the trailing edge supporting tray 103 is straight. Therefore, if the trailing edge supporting tray 103 is immovable from the usage position, this version of modification of the first embodiment is less in operability in the operation to set a long sheet of recording medium in the sheet feeding portion 100 than the first embodiment. In comparison, in this modified version of the first embodiment, the sheet feeding portion 100 is structured so that the trailing edge supporting tray 103 having the slant portion 112 is pivotally movable between the usage position and retraction position. Therefore, the sheet feeding portion 100 in this modified version of the first embodiment is superior to any conventional one, in the operability in the operation to set a sheet P of recording medium in the manual feeding portion 100, while being able to prevent a long sheet P of recording medium from suffering from the contact marks.

(Modification 3)

In the first embodiment, the trailing edge supporting tray 103 was formed of a piece of wire (rod). However, the present invention is also compatible with a trailing edge supporting tray 103 formed of a flat piece of resinous substance or the like.

(Modification 4)

In the first embodiment, the sheet feeding portion 100 was designed so that the manual sheet feeder door 60*a* is provided with the tray rest 60*a*, and the trailing edge supporting tray 103 is held in the retraction position as it comes into contact with the tray rest 60*a*. The first embodiment, however, is not intended to limit the present invention in scope in terms of the structure of the sheet feeding portion 100. For example, the present invention is also compatible with a sheet feeding portion structured so that the trailing edge supporting tray 103 is held in its usage position by the contact between the leading edge portion 103*c* (FIG. 3(*a*)) of the trailing edge supporting tray 103, and the side wall if of the apparatus main assembly 1A. In such a case, when the area of the side surface 1*f*, which comes into contact with the leading portion 103*c* of the trailing edge supporting tray 103 when the trailing edge supporting tray 103 is in the retraction position, functions as the second holding portion.

Embodiment 2

Next, referring to FIGS. 6(*a*) and 6(*b*), the manual feeding portion 100 in the second embodiment of the present invention is described about its structure. This embodiment is different from the first one in that the trailing edge supporting tray 103 and tray holding portion 104 are supported by the apparatus main assembly 1A of the image forming apparatus 1, without the presence of the manual feeder door 60 between the trailing edge supporting tray 103 and apparatus main assembly 1A.

That is, the trailing edge supporting tray 103 in this embodiment pivotally supported by the tray holding portion 104 directly fixed to the side surface if of the apparatus main assembly 1A. FIG. 6(*a*) shows the manual feeding portion 100 which is in the state in which the trailing edge supporting tray 103 is in its retraction position, and FIG. 6(*b*) shows the manual feeding portion 100 which is in the state in which the trailing edge supporting tray 103 is in its usage position. Otherwise, the elements in FIGS. 6(*a*) and 6(*b*), which are the same in referential code as the counterparts in the first embodiment are practically the same in structure and function.

In this embodiment, it was possible for the trailing edge supporting tray 103 to be moved between its usage position and retraction position by structuring the manual feeding portion 100 as described above. Therefore, the trailing edge supporting tray 103 is held in the retraction position by its own weight. Therefore, the manual feeding portion 100 is superior to any conventional manual feeding portion in operability in terms of the operation to set a sheet of recording medium in the manual feeding portion 100.

In this embodiment, the side surface if of the apparatus main assembly 1A is stair-stepped. That is, its bottom portion is more protrusive upstream in terms of the sheet feeding direction Fd than the top portion (FIG. 6(*a*)). The top portion 115 of this stair-stepped portion functions as the second holding portion which holds the trailing edge supporting tray 103 in the retraction position, by catching the trailing edge supporting tray 103 as the trailing edge supporting tray 103 is pivoted upward from its usage position.

By the way, also in this embodiment, the manual feeder tray 101 and sheet feeding unit 105 are supported by the apparatus main assembly 1A, with the presence of the manual feeder door 60 between the side surface if of the apparatus main assembly 1A and the manual feeding portion 100, as in the first embodiment. However, the sheet feeding portion 100 may be structured so that manual feeder tray 101 and sheet feeding unit 105 are directly held by the apparatus main assembly 1A.

(Miscellanies)

In the above-described first and second embodiments and their modified versions, the sheet feeding apparatus was attached to the side surface of the apparatus main assembly 1A of the image forming apparatus 1. This technology, however, is also applicable to other sheet feeding apparatuses. For example, it is also applicable to an image forming apparatus which has an optional sheet feeder connected to the apparatus main assembly 1A which contains the image forming portion, to send a sheet of recording medium toward the apparatus main assembly 1A, and is structured so that one of the sheet feeding apparatuses in the above described embodiments is attached to the side surface of the casing of an optional feeder. In such a case, as a sheet of recording medium is fed into the apparatus main assembly 1A, it is caught by the casing of the optional feeder, and then, is fed into the apparatus main assembly 1*a* by way of the sheet passage in the casing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-054354 filed on Mar. 25, 2020, which is hereby incorporated by reference herein in its entirety.

What is claimed is:

1. An image forming apparatus comprising:

a casing configured to accommodate an image forming unit forming an image on a sheet;

a manual feeder door provided on a side portion of the casing and configured to move with respect to the casing for opening a transport path through which the sheet is transported;

a manual feeder tray provided on the manual feeder door and configured to support the sheet;

a trailing edge supporting member provided on the manual feeder door and above the manual feeder tray with respect to a vertical direction, the trailing edge supporting member supporting a trailing edge portion of the sheet of which a leading edge portion is supported by the manual feeder tray; and a feeding unit configured to feed the sheet, of which the leading edge portion is supported by the manual feeder tray and the trailing edge portion is supported by the trailing edge supporting member, toward the image forming unit in a feeding direction, wherein the trailing edge supporting member is configured to rotate about a shaft extending in a sheet width direction that is perpendicular to the feeding direction as a rotational center between a usage position and a retraction position, wherein the usage position is a position where the sheet to be used is supported and a center of gravity of the trailing supporting member is more apart from the image forming unit than the rotational center is from the image forming unit with respect to a horizontal direction that is perpendicular to the vertical direction and the sheet width direction, wherein the retraction position is a position where the trailing supporting member is retracted and the center of gravity of the trailing supporting member is at a side closer to the image forming unit than the rotational center is to the image forming unit with respect to the horizontal direction, and wherein the image forming apparatus further comprises a contact portion provide on the manual feeder door and configured to contact the trailing edge supporting member positioned at the retraction position to restrict rotation about the rotational center of the trailing edge supporting member in a direction from the usage position to the retraction position.

2. An image forming apparatus according to claim 1, wherein the trailing edge supporting member is formed of a metallic wire material.

3. An image forming apparatus according to claim 1, wherein the trailing edge supporting member is formed of one wire material and both ends of the wire material constitutes the rotational shaft, and wherein in a state in which the trailing edge supporting member is positioned at the usage position, a part between both ends of the wire material is bent so as to be a supporting portion for supporting the trailing portion.

4. An image forming apparatus according to claim 1, wherein the trailing supporting member includes:

a supporting portion extending from the rotational shaft to an upstream side and configured to support the trailing edge portion of the sheet in the state in which the trailing edge supporting member is positioned at the usage position, and an inclined portion provided on an end portion side farther than the rotational shaft and inclined to the supporting portion so as to approach to the manual feeder tray toward upstream of the feeding direction in the state in which the trailing edge supporting member is positioned at the usage position.

5. An image forming apparatus according to claim 1, further comprising a locking portion configured to hold the trailing edge supporting member at the usage position by contacting the trailing edge supporting member positioned in the usage position from below.

6. An image forming apparatus according to claim 1, wherein the manual feeder tray supports the leading edge portion of the sheet by contacting the first surface of the sheet, and wherein the trailing edge supporting member supports the trailing edge portion of the sheet by contacting the second surface of the sheet opposite to the first surface.

7. An image forming apparatus according to claim 1, wherein the sheet supported on the manual feeder tray is longer than a standard size sheet.

8. An image forming apparatus according to claim 1, wherein the trailing edge supporting member does not contact the casing in the state in which the trailing edge supporting member is positioned at the retraction position.

9. An image forming apparatus comprising:

a casing configured to accommodate an image forming unit forming an image on a sheet;

a manual feeder tray provided on a side portion of the casing and configured to support the sheet;

a trailing edge supporting member provided above the manual feeder tray with respect to a vertical direction, the trailing edge supporting member supporting a trailing edge portion of the long sheet of which a leading edge portion is supported by the manual feeder tray; and a feeding unit configured to feed the sheet, of which the leading edge portion is supported by the manual feeder tray and the trailing edge portion is supported by the trailing edge supporting member, toward the image forming unit in a feeding direction, wherein the trailing edge supporting member is configured to rotate about a shaft extending in a sheet width direction that is perpendicular to the feeding direction as a rotational center between a usage position and a retraction position, wherein the usage position is a position where the sheet to be used is supported and a center of gravity of the trailing supporting member is more apart from the image forming unit than the rotational center is from the image forming unit with respect to a horizontal direction perpendicular to the vertical direction and the sheet width direction, wherein the retraction position is a position where the trailing supporting member is retracted and the center of gravity of the trailing supporting member is at a side closer to the image forming unit than the rotational center is to the image forming unit with respect to the horizontal direction, and wherein the trailing edge supporting member includes:

a supporting portion extending from the rotational shaft to an upstream side in the feeding direction and configured to support the trailing edge portion of the sheet in the state in which the trailing edge supporting member is positioned at the usage position, and an inclined portion provided on an end portion side that is farther than the rotational shaft and inclined to the supporting portion so as to approach to the manual feeder tray toward upstream of the feeding direction in the state in which the trailing edge supporting member is positioned at the usage position.

* * * * *